US007849699B2

(12) United States Patent
Allen

(10) Patent No.: US 7,849,699 B2
(45) Date of Patent: Dec. 14, 2010

(54) DIGITAL CONTROL OF ICE MAKING APPARATUS AND OUTPUT OF OPERATING STATUS

(75) Inventor: Kendall E. Allen, Bumpass, VA (US)

(73) Assignee: Dometic Corporation, Elkhart, IN (US)

( * ) Notice: Subject to any disclaimer, the term of this patent is extended or adjusted under 35 U.S.C. 154(b) by 343 days.

(21) Appl. No.: 11/623,445

(22) Filed: Jan. 16, 2007

(65) Prior Publication Data

US 2007/0180837 A1 Aug. 9, 2007

Related U.S. Application Data

(60) Provisional application No. 60/765,050, filed on Feb. 3, 2006.

(51) Int. Cl.
*F25C 1/14* (2006.01)

(52) U.S. Cl. ..... 62/129; 62/135; 62/354; 62/161

(58) Field of Classification Search ..... 62/135, 62/125–131, 340–356, 161
See application file for complete search history.

(56) References Cited

U.S. PATENT DOCUMENTS 4,872,317 A * 10/1989 Reed ..... 62/135
5,829,257 A * 11/1998 Newman et al. ..... 62/73
6,574,974 B1 * 6/2003 Herzog et al. ..... 62/135
6,895,676 B1 * 5/2005 Mendyk ..... 33/265
2005/0028539 A1 * 2/2005 Singh et al. ..... 62/127
2006/0277928 A1 * 12/2006 McDougal et al. ..... 62/66
2007/0130965 A1 * 6/2007 Boarman et al. ..... 62/135
2007/0157636 A1 * 7/2007 Billman et al. ..... 62/73
2007/0186570 A1 * 8/2007 Kopf ..... 62/135

* cited by examiner

*Primary Examiner*—William E Tapolcai
(74) *Attorney, Agent, or Firm*—Pearne & Gordon LLP

(57) ABSTRACT

The subject application relates to a remote control system and method for an ice maker machine. The system, for example, can monitor and regulate the operations of a plurality of ice maker components. An output display can also be employed in order to output relevant operating statuses to a user remotely or at a distance from the ice maker machine. The system can receive user input as well as sensor input and control the operation of the ice maker according to both types of input. As a result, a user can remotely determine failure modes and efficiently troubleshoot them as well as maintain an overall awareness of the operation status of the ice maker without physical interaction with the machine.

18 Claims, 7 Drawing Sheets

300

| EXEMPLARY INPUTS |
|---|
| 1. ON/OFF SWITCH: OPEN = OFF |
| 2. RESET SWITCH: OPEN = NO RESET |
| 3. ICE LEVEL SENSOR: OPEN = NO ICE DETECTED |
| 4. HIGH PRESSURE SENSOR: CLOSED = NORMAL PRESSURE |
| 5. ICE CLOG SWITCH: CLOSED = NO CLOG |
| 6. FEED WATER LEVEL SENSOR: LEVEL OK |
| 7. LOW PRESSURE SWITCH: CLOSED = NORMAL PRESSURE |
| 8. AUGER MOTOR START SWITCH: CLOSED = MOTOR ON |

400

| EXEMPLARY OUTPUTS |
|---|
| 1. COMPRESSOR/AUGER/SEA WATER PUMP RELAY INDICATOR LIGHT = ON |
| 2. ICE CLOG FAULT LIGHT = ON |
| 3. WATER LEVEL FAULT LIGHT = ON |
| 4. PRESSURE FAULT LIGHT = ON |
| NOTE: ON = ENERGIZED |

300

| EXEMPLARY INPUTS |
| --- |
| 1. ON/OFF SWITCH: OPEN = OFF |
| 2. RESET SWITCH: OPEN = NO RESET |
| 3. ICE LEVEL SENSOR: OPEN = NO ICE DETECTED |
| 4. HIGH PRESSURE SENSOR: CLOSED = NORMAL PRESSURE |
| 5. ICE CLOG SWITCH: CLOSED = NO CLOG |
| 6. FEED WATER LEVEL SENSOR: LEVEL OK |
| 7. LOW PRESSURE SWITCH: CLOSED = NORMAL PRESSURE |
| 8. AUGER MOTOR START SWITCH: CLOSED = MOTOR ON |

FIG. 3

400

| EXEMPLARY OUTPUTS |
| --- |
| 1. COMPRESSOR/AUGER/SEA WATER PUMP RELAY INDICATOR LIGHT = ON |
| 2. ICE CLOG FAULT LIGHT = ON |
| 3. WATER LEVEL FAULT LIGHT = ON |
| 4. PRESSURE FAULT LIGHT = ON |
| NOTE: ON = ENERGIZED |

FIG. 4

DIGITAL CONTROL OF ICE MAKING APPARATUS AND OUTPUT OF OPERATING STATUS

CROSS-REFERENCE TO RELATED APPLICATION

This application claims the benefit of U.S. Provisional Application No. 60/765,050 entitled Method of Digital Control of Ice Making Apparatus and Output of Operating Status and filed on Feb. 3, 2006, which is entirely incorporated herein by reference.

TECHNICAL FIELD

The subject application generally relates to HVAC (heating, ventilation, and air conditioning) systems and in particular to ice maker systems used primarily in various types of land, air, and marine transportation vessels such as motor homes, boats, trucks, and airplanes that can be monitored and controlled in a remote manner.

BACKGROUND OF THE INVENTION

Conventional ice making machines such as those primarily used on marine vessels, air transportation, or recreational land vehicles often require a user to manually interface with the unit. This can be rather difficult and cumbersome depending on where the machine is mounted. In addition, such conventional ice making machines employ electromechanical switches to control limited operations of the apparatus. Unfortunately, these switches are insufficient to reliably and safely control all functions or operations of the apparatus. For instance, when a traditional safety switch shuts down the apparatus, it must be manually reset by the user before the machine can be fully operational again. If the switch is tripped frequently when no real problem exists, the user is likely to disable the switch, which can have dire consequences on the reliability or safety of the machine in the event a true problem arises.

SUMMARY OF THE INVENTION

The following presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

According to one aspect of the subject application, a remote ice maker control system comprises a plurality of ice maker components that cooperatively function as an ice maker machine; a plurality of at least one of sensors and switches corresponding to at least one of the plurality of ice maker components; a central processor that monitors and controls operations of a plurality of ice maker components using, at least in part, input from at least one of: at least one sensor or at least one switch; and an output display remotely located from at least a portion of the ice-maker components that presents one or more visual indicators based on at least one of sensor input and switch input to facilitate maintaining user awareness of the operations of the ice maker components at a distance from the ice maker machine.

According to another aspect of the subject application, a method that facilitates remote control of an ice maker machine comprises monitoring a state of one or more ice maker components; detecting at least one state change; analyzing state change according to one or more set operational parameters to determine an occurrence of at least one failure mode; and remotely displaying at least one visual indicator corresponding to the at least one state change to facilitate maintaining user awareness of the ice maker machine at a distance from the machine.

According to a further aspect of the subject application, a method that facilitates remote control of an ice maker machine comprises monitoring ice maker component activity relative to corresponding operational parameters; receiving a change to at least one operational parameter; and determining effects to unchanged operational parameters. Still a further aspect involves using artificial intelligence to learn from other failure occurrences and use conditions present at the time of those failures to predict when another similar failure might occur; and displaying a warning of one or more imminent failures that are likely to occur to mitigate undesirable consequences resulting from an actual failure.

To the accomplishment of the foregoing and related ends, certain illustrative aspects of the invention are described herein in connection with the following description and the annexed drawings. These aspects are indicative, however, of but a few of the various ways in which the principles of the invention may be employed and the subject invention is intended to include all such aspects and their equivalents. Other advantages and novel features of the invention may become apparent from the following detailed description of the invention when considered in conjunction with the drawings.

BRIEF DESCRIPTION OF THE DRAWINGS

A brief description of each drawing is as follows:

FIG. 3 is a diagram representing exemplary types of input that the remote digital control system of FIG. 1 or FIG. 2 can use to facilitate controlling an ice maker machine in a remote manner.

FIG. 4 continues from FIG. 3 and is a diagram representing exemplary outputs that can be visually displayed to assist a user in ascertaining the status of various parts of the ice maker machine.

DETAILED DESCRIPTION OF THE INVENTION

Figure 1:
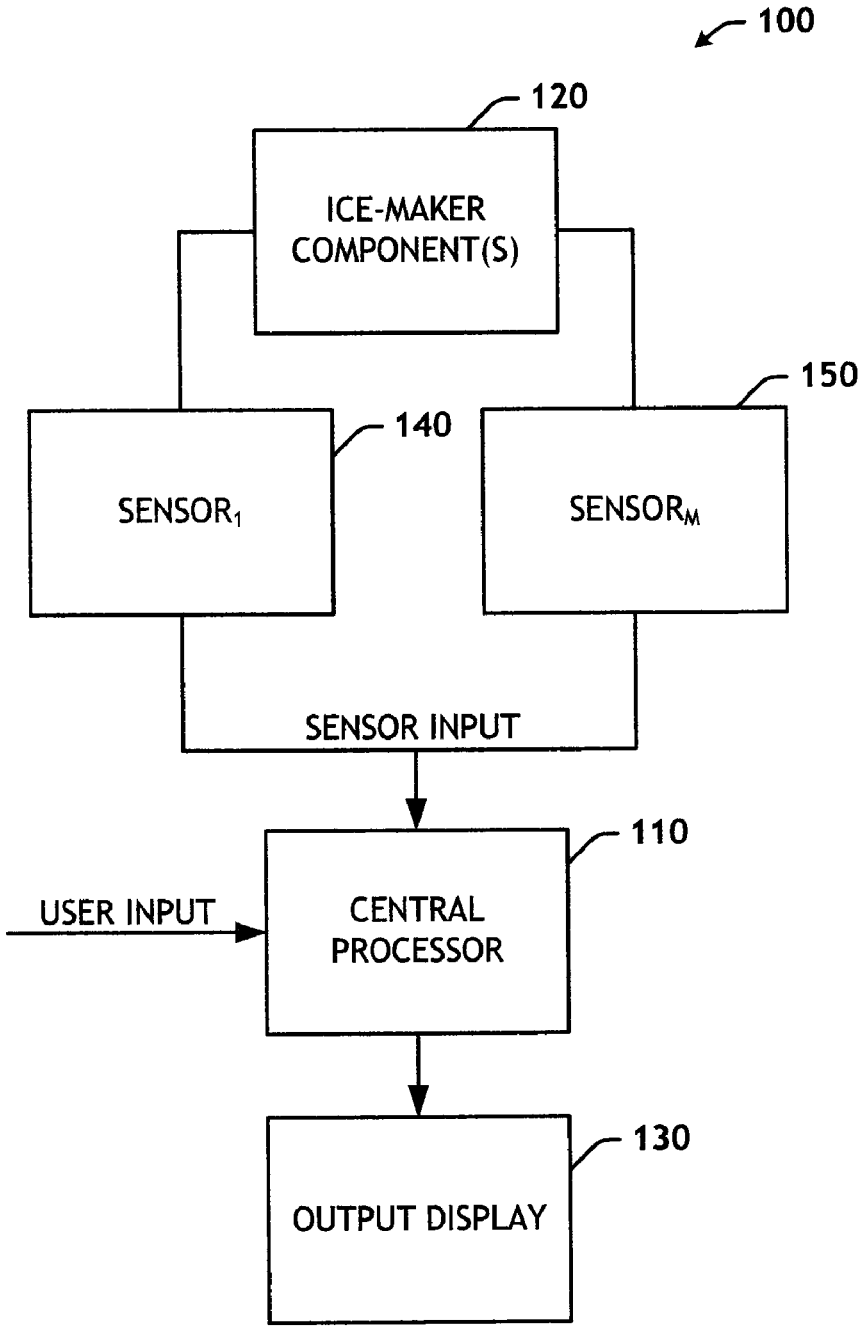
FIG. 1 is a general block diagram of a remote digital control system as employed in conjunction with an ice maker machine that facilitates monitoring and controlling the machine in a remote manner.

The subject systems and/or methods are now described with reference to the drawings, wherein like reference numerals are used to refer to like elements throughout. In the following description, for purposes of explanation, numerous specific details are set forth in order to provide a thorough understanding of the systems and/or methods. It may be evident, however, that the subject systems and/or methods may be practiced without these specific details. In other instances, well-known structures and devices are shown in block diagram form in order to facilitate describing them.

The subject application is directed to digital control systems and in particular to monitoring and controlling an ice-making apparatus in a remote manner in order to facilitate determining a failure state in any portion of the apparatus more efficiently. Unlike conventional ice making apparatuses, the subject systems and methods can present the status of various functions or operations of the ice making apparatus to a user at a distance or away from the actual ice making unit. Troubleshooting failure states can be performed more efficiently as well due to the improved ability to digitally set operating parameters and the inclusion of multiple sensors and/or switches based thereon. As a result, unnecessary resets of the unit can be mitigated. Security features can also be added to thwart the ability to override or disable safety mechanisms. Moreover, the unit can be controlled or managed from a distance, thus mitigating the constant need for direct user contact with the unit wherever it is mounted, such as below deck in an engine room of a boat.

Referring now to FIG. 1, there is a general block diagram of a remote digital control system 100 as employed in conjunction with an ice maker machine that facilitates monitoring and controlling the machine in a remote manner. The system 100 includes a central processor 110 that can monitor and control multiple operations corresponding to various ice maker components 120. In particular, a user can enter data for to set one or more parameters that dictate the normal function of the ice maker components 120. The central processor 120 can control the operation of the ice maker components based on the set parameters. For example, the central processor control the functioning of the components once the power switch is energized (i.e., turned on). After the switch is turned on and no faults or failures are detected, then a timer parameter can be activated. The central processor can control this series of events and/or take action if a prescribed event or parameter setting is not performed accordingly. For example, the central processor can notify the user that ice is being made (or that ice is not being made when it should be) or can adjust other settings so that the desired amount of ice is made.

An output display 130 can visually depict the current state of the machine. For instance, visual indicators can be used to notify the user of power on/off, ice clog, water level, pressure, and the like. In practice, for example, a green light can indicate "power on" whereas a red light can indicate power off. No light for "ice clog" can indicate "no clog" but a solid red or orange light can signal a clog exists. Other data can be also presented in the output display 130 such as in the form of alpha-numeric messages.

A plurality of sensors ($SENSOR_1$, 140; $SENSOR_M$ 150, where M is an integer greater than one) and/or switches can be employed to facilitate detecting failures or problems with one or more ice maker components 120. The central processor 110 can receive input from the sensors and then can make adjustments to the corresponding component in response to the sensor. In addition or alternatively, the central processor 110 can notify the user of the activated sensor as well as of the adjustment by way of the output display 130.

The central processor 110 can also predict imminent failures in one or more components 120 based in part on the current state of the particular component and then warn the user such as by activating a flashing indicator. For example, suppose that a clog does not exist yet in the ice delivery line but that the central processor 110 determines that the amount of ice being delivered to an ice receptacle (from which none has been dispensed yet) does not approximately equate to the amount of ice that was made. The central processor 110 can warn the user that a clog is imminent or likely to occur so that the user can investigate or take other remedial measures.

In addition, the central processor 110 can detect when the user attempts to override or disable a sensor or switch. When such is detected, the central processor 110 can trigger a fault in the component. In some cases, the central processor can require an authorized technician to clear the fault and reset the component and/or the ice maker machine.

Figure 2:
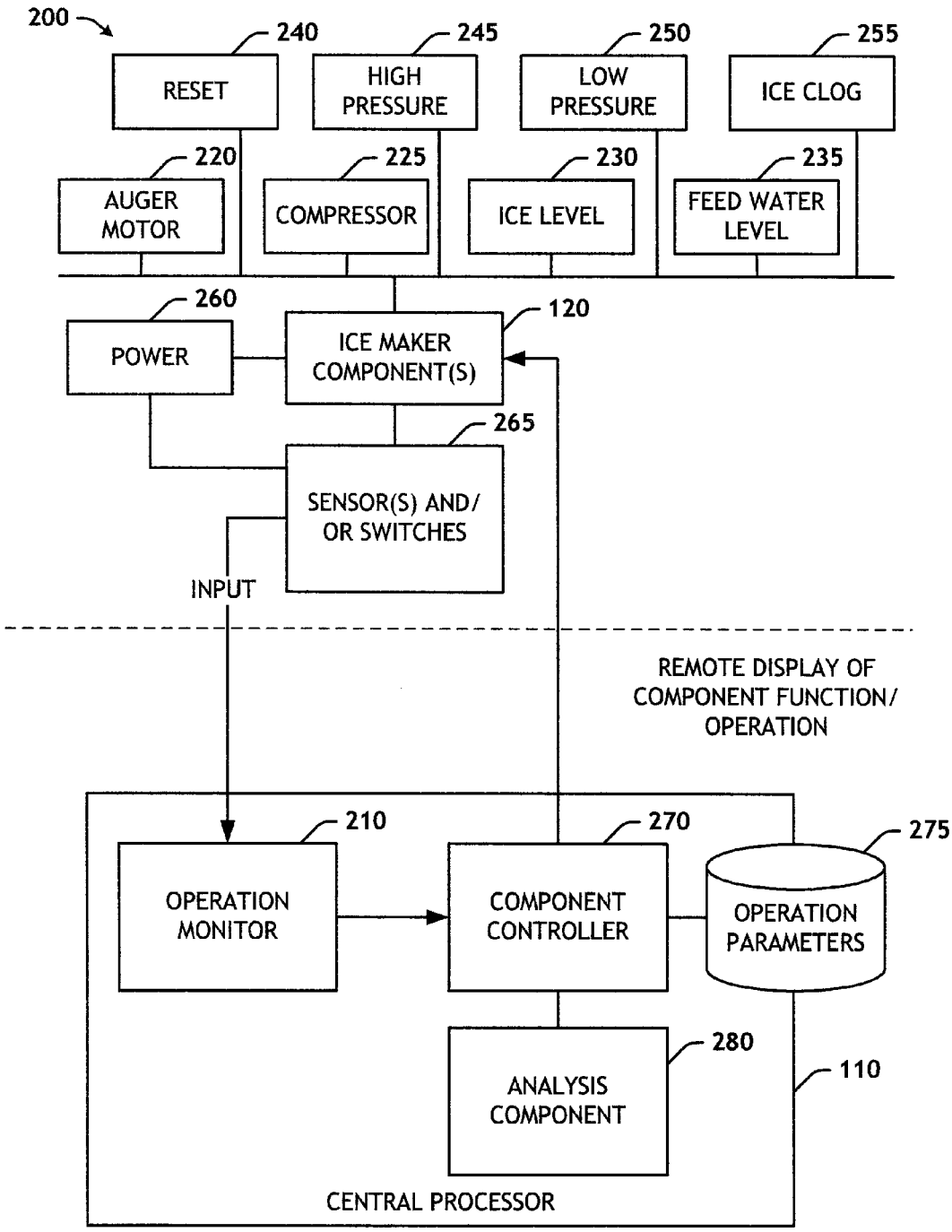
FIG. 2 is a block diagram of another aspect of a remote digital control system as employed with an ice maker machine which allows the machine to be monitored and controlled in a remote manner.

Turning now to FIG. 2, there is a block diagram of another aspect of a remote digital control system 200 as employed with an ice maker machine, which allows the machine to be monitored and controlled in a remote manner. The system 200 includes the central processor 110 as described in FIG. 1, which comprises an operation monitor 210 that can observe activity and/or inactivity of the various ice maker components 120. The ice maker components 120 can include, but is not limited to, an auger motor 220, a compressor 225, an ice level 230, a feed water level 235, a reset feature 240, a high pressure control 245, a low pressure control 250, an ice clog control 255, and a power feature 260. At least one sensor or switch 265 can be programmed and assigned to each of these components 120.

A component controller 270 regulates the ice maker components 120 based in part on operation parameters 275 stored in a database or memory store. The parameters 275 can be set by the user. In addition, the component controller 270 can make adjustments to parameters based on the user's settings and as the user's needs for ice change. For example, when the user increases the timer parameter to a higher count, the component controller 270 can adjust the other parameter settings, sensors, and/or switches based on the increased timer count. An analysis component 280 can assist the component controller 270 in analyzing the sensor input and the user input. Moreover, the central processor 110 allows a user to monitor and control the operation of the ice maker from a location away from the actual ice maker machine. As a result, problems can be attended to and adjustments can be made more efficiently.

Turning now to FIGS. 3 and 4, there are diagrams of exemplary inputs 300 and outputs 400, respectively, that can be utilized to control an ice maker machine in a remote manner. For example, in practical operation, imagine that Input 1 changes to "on" (switch closed), which energizes a control circuit through a logic controller. If Input 1 is "on" and no faults are detected, then the timer starts and counts 2 minutes, and then Output 1 changes to "on." If Input 3 changes to "on" (closed; ice detected), then the timer is initiated. After 30 seconds, Output 1 changes to "off." If Input 3 changes to "off" (reopens) before the timer reaches 30 seconds, then the timer is reset to 0. When Input 3 changes to "off" after Output 1 has changed to "off," then timer counts to 2 minutes before Output 1 changes back to "on."

If Input 4 changes to "on" (open), then Output 1 changes to "off." The timer is initiated and a counter is advanced to 1. After 2 minutes and if counter is less than 3, Output 1 changes to "on." If counter reaches 3 within a 45 minute period, then Output 1 locks out "off" and Output 4 is changed to "on." System must now be reset with input 2. When Input 2 is activated, the timer starts and counts to 2 minutes before changing Output 1 to "on."

If Input 5 changes to "on" (open), then Output 1 changes to "off" and Output 2 changes to "on." The system must now be reset with Input 2. When Input 2 is activated, the timer starts and counts to 2 minutes before changing Output 1 to "on."

If Input 6 changes to "on" (open), then Output 1 changes to "off" and Output 3 changes to "on." Again, the system must now be reset with Input 2. When Input 2 is activated, the timer starts and counts to 2 minutes before changing Output 1 to "on."

If Input 7 changes to "on" (open), then Output 1 changes to "off." The timer is initiated and a counter is advanced to 1. After 3 minutes and input 7 is closed and if the counter is less than 6, Output 1 changes to "on." If the counter reached 6 within a 45 minute period, then Output 1 locks "off" and Output 4 is changed to "on." Again, the system must now be reset with Input 2. When Input 2 is activated, the timer starts and counts to 2 minutes before changing Output 1 to "on." The central processor can be programmed to prohibit a reset from occurring via Input 1. Similarly, if the machine loses power, then the compressor should not be able to immediately restart upon regaining power. This can be controlled by using a timer, for example, in conjunction with the power on/off switch.

Inputs can be entered and outputs can be displayed remotely from the actual ice maker machine unit, thereby affording the user more flexibility and efficiency when using the machine. For instance, on a marine vessel such as a fishing boat, the ice maker unit can be installed out of sight such as below deck in an engine room. Ice can be made and delivered from the engine room up to an ice receptacle on deck. The control display can be located on deck as well, thereby allowing the user to maintain an awareness of the current state of the ice maker machine and its various components without having to go below deck to check and look at the machine. In some ice makers, the ice can be made on deck—remotely from the compressor and auger components in order to mitigate ice clog problems during delivery. Here again, the remote control system and display can relay the status and readily identify problem areas or failures in particular components to the user and allow the user to assess the failure and in some instances repair the failure remotely from the failure source (e.g., compressor, auger, etc.).

Figure 5:
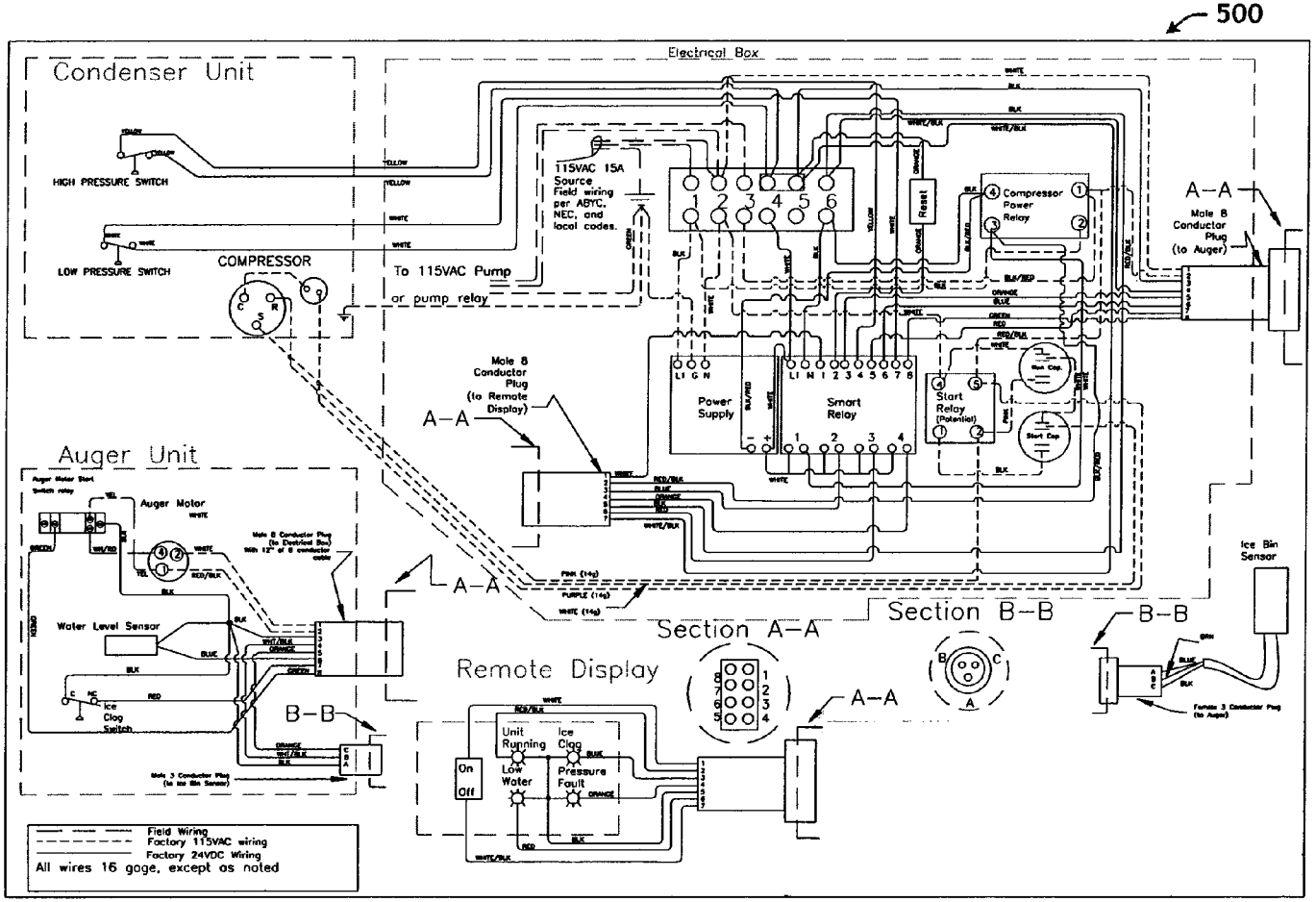
FIG. 5 is an exemplary wiring diagram for a remote digital control system as used in conjunction with an ice maker machine in order to monitor and control the operation of the machine in a remote manner.

Referring to FIG. 5, there is an exemplary wiring diagram 500 for a remote control system as used in conjunction with an ice maker machine in order to monitor and control the operation of the machine in a remote manner. It should be appreciated that other wiring configurations are possible in order to perform or accomplish the subject application as described herein.

Various methodologies will now be described via a series of acts. It is to be understood and appreciated that the subject system and/or methodology is not limited by the order of acts, as some acts may, in accordance with the subject application, occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the subject application.

Figure 6:
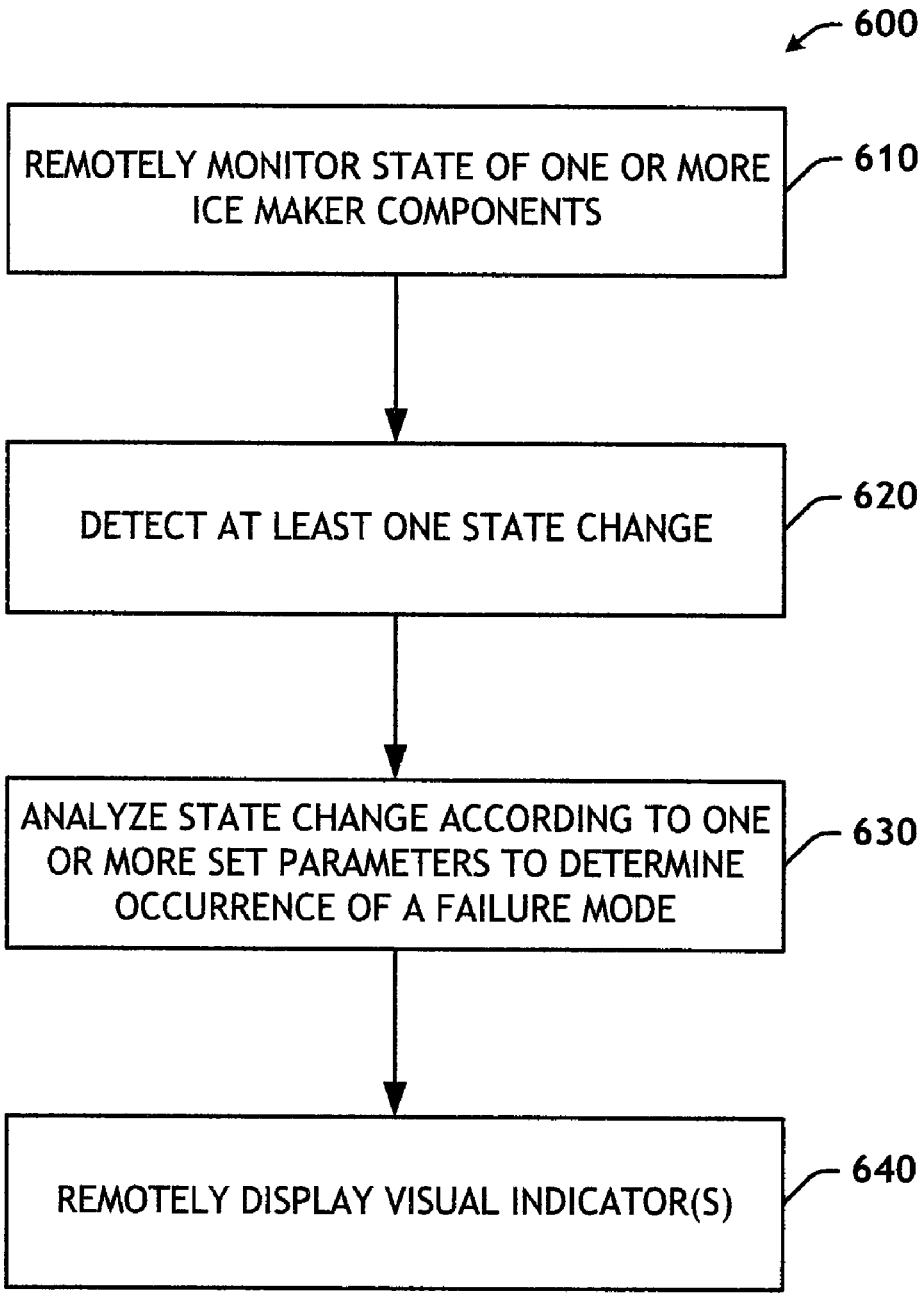
FIG. 6 is a flow diagram of an exemplary method for monitoring and controlling an ice maker machine in a remote manner.

FIG. 6 is a flow diagram of an exemplary method 600 for monitoring and controlling an ice maker machine in a remote manner. The method 600 comprises remotely monitoring a state of one or more ice maker components at 610. At 620, at least one change in state of the components can be detected. The state change can be analyzed according to one or more set operation parameters at 630 to determine whether a failure in one or more components has occurred. At 640, one or more visual indicators can be remotely displayed to mitigate direct hands-on interaction with the actual ice maker.

Figure 7:
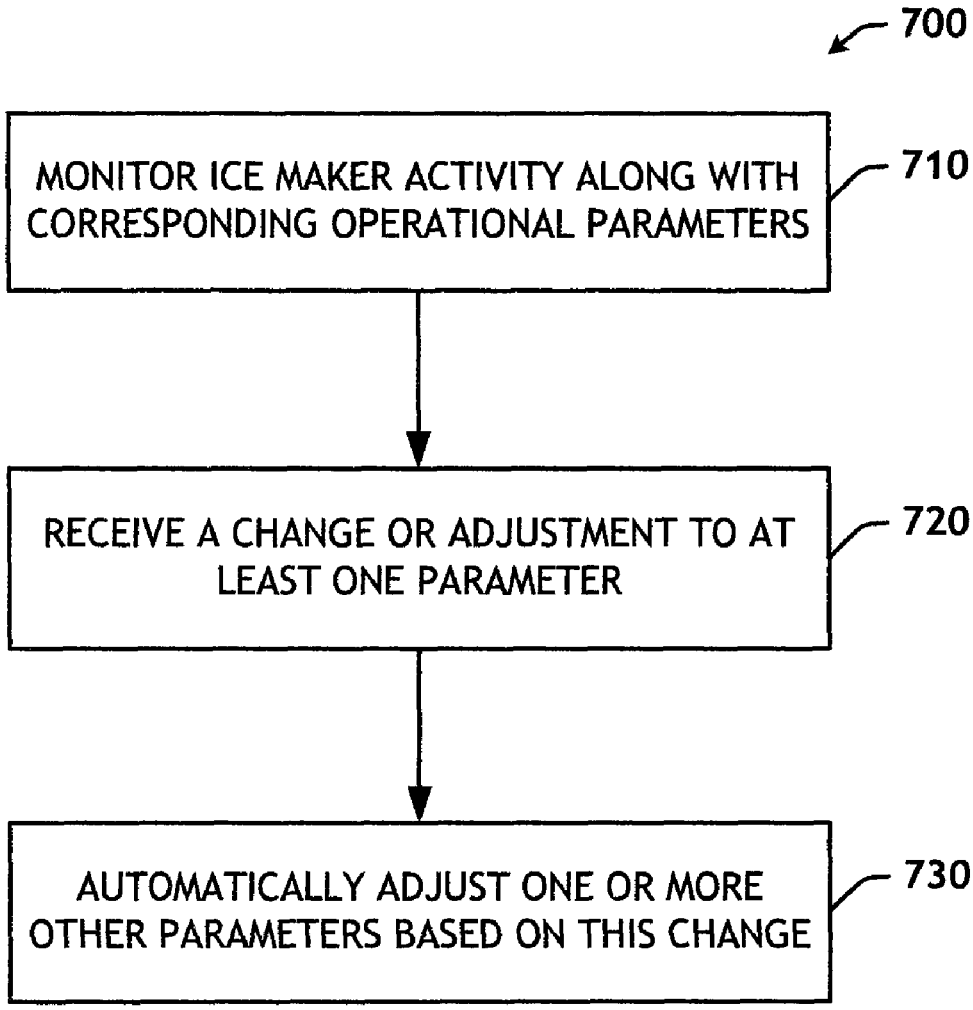
FIG. 7 is a flow diagram of another aspect of an exemplary method for monitoring and controlling an ice maker machine in a remote manner.

In FIG. 7, a flow diagram demonstrates an exemplary method 700 of controlling an ice maker machine in a remote manner. In particular, the method 700 comprises monitoring ice maker activity along with corresponding operational parameters such as those set by a user at 710. At 720, a parameter is changed or adjusted. At 730, the method 700 can automatically adjust one or more other parameters based on this change without manual user input. In the alternative, the method 700 can provide or display suggestions of parameter changes and give the user an option or accept, reject, or modify them in this remote manner.

Though not depicted in the flow diagrams, the method 600 or 700 can also warn of imminent problems or failures that are likely to occur through the use of artificial intelligence. For example, the method can learn from other failure occurrences and use conditions present at the time of those failures to predict or project when another similar failure might occur. By doing so, failures can be somewhat prevented in order to mitigate undesirable consequences or the extent of damage as a result of such failures (e.g., food spoilage).

What has been described above includes examples of the subject system and/or method. It is, of course, not possible to describe every conceivable combination of components or methodologies for purposes of describing the subject system and/or method, but one of ordinary skill in the art may recognize that many further combinations and permutations of the subject system and/or method are possible. Accordingly, the subject system and/or method are intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A remote ice maker control system comprising:

a plurality of ice maker components that cooperatively function as an ice maker machine;

a plurality of at least one of sensors and switches corresponding to at least one of the plurality of ice maker components;

a central processor that monitors and controls operations of the plurality of ice maker components using, at least in part, input from at least one of: at least one sensor or at least one switch, wherein the central processor determines that a fault condition exists based on the input from the at least one sensor or the at least one switch, makes at least one attempt to automatically reset the fault condition, and transmits a signal to deactivate at least one of the ice maker components in response to a determination that the at least one attempt was unsuccessful, requiring a manual reset to reactivate the at least one of the ice maker components that was deactivated; and an output display remotely located from at least a portion of the ice-maker components to be observable by a user at a remote location that is a distance away from the portion of the ice-maker components from where the user does not have direct access to the portion of the ice-maker components, said output display presenting one or more visual indicators to the user at the remote location based on at least one of sensor input and switch input to facilitate maintaining user awareness of the operations of the ice maker components at a distance from the ice maker machine.

2. The system of claim 1, wherein the central processor communicates with the ice maker components, sensors, switches in a remote manner.

3. The system of claim 1, wherein the central processor receives at least one of sensor input and user input, wherein the user input is used in part to set a plurality of operational parameters for the ice maker components.

4. The system of claim 1, wherein the central processor processes the sensor input to determine whether at least one failure has occurred.

5. The system of claim 1 further comprising a data store that comprises a plurality of operational parameters corresponding to the plurality of ice maker components.

6. The system of claim 1, wherein the central processor comprises:

an operational monitor that monitors operation activity of one or more ice maker components and that receives sensor input from one or more activated sensors; and a component controller that regulates operation activity of the one or more ice maker components based on respective operational parameters, additional user input, and sensor input.

7. The system of claim 1, wherein the central processor automatically adjusts one or more operational parameters based at least in part on at least one of additional user input or a change in an operational parameter.

8. The system of claim 1, wherein the central processor analyzes sensor input and presents one or more suggestions to adjust or repair affected ice maker components.

9. The system of claim 1, wherein the central processor comprises an artificial intelligence component that predicts a failure is likely to occur and transmits a signal to activate at least one of the visual indicators of the output display and provide a warning to a user before said failure occurs.

10. The system of claim 9, wherein the warning is in a form of a flashing indicator and the flashing indicator comprises at least one of a message or a light.

11. The system of claim 1, wherein the central processor triggers a fault when an attempt to disable at least one of a sensor or a switch is detected, thereby prohibiting further operation of the ice maker machine until the fault is cleared by an authorized technician.

12. The system of claim 1, wherein the plurality of ice maker components comprises an auger motor, a compressor, an ice level feature, a feed water level feature, a reset feature, a high pressure feature, a low pressure feature, and an ice clog feature.

13. A marine vessel provided with the remote ice maker control system of claim 1, wherein the plurality of ice maker components are disposed within a compartment on the marine vessel, and the output display is located at another location on the marine vessel outside of the compartment from where it can be viewed by an occupant of the marine vessel while outside of the compartment.

14. The system of claim 1, wherein the central processor comprises a component that is operable to detect an attempt by the user to override or disable at least one of the sensors or switches associated with a first ice-maker component and trigger a fault in the first ice-maker component.

15. The system of claim 14, wherein the central processor is operable to maintain the fault, requiring an authorized technician to input a reset instruction to clear the fault before returning the first-ice maker component to operation.

16. The remote ice maker control system of claim 1 further comprising a power switch that is operatively connected to at least one of the ice maker components to control activation of the at least one of the ice maker components, wherein the central processor prohibits the manual reset from being performed via the power switch.

17. A marine vessel provided with the remote ice maker control system of claim 1, wherein the compartment is located below deck on the marine vessel and the output display is provided on another level of the marine vessel above deck.

18. A remote ice maker control system comprising:

a plurality of ice maker components that cooperatively function as an ice maker machine, the plurality of ice maker components comprising an auger motor, a compressor, an ice level feature, a feed water level feature, a reset feature, a high pressure feature, a low pressure feature, and an ice clog feature;

a plurality of at least one of sensors and switches corresponding to at least one of the plurality of ice maker components;

a central processor that monitors and controls operations of the plurality of ice maker components using, at least in part, input from at least one of: at least one sensor or at least one switch; and an output display remotely located from at least a portion of the ice-maker components that presents one or more visual indicators based on at least one of sensor input and switch input to facilitate maintaining user awareness of the operations of the ice maker components at a distance from the ice maker machine.

* * * * *